US009837058B2

(12) United States Patent
Trask

(10) Patent No.: US 9,837,058 B2
(45) Date of Patent: Dec. 5, 2017

(54) FLEXIBLE SHAKER PERCUSSION INSTRUMENT

(71) Applicant: Joshua Andrew Trask, Moravian Falls, NC (US)

(72) Inventor: Joshua Andrew Trask, Moravian Falls, NC (US)

( * ) Notice: Subject to any disclaimer, the term of this patent is extended or adjusted under 35 U.S.C. 154(b) by 0 days.

(21) Appl. No.: 15/148,921

(22) Filed: May 6, 2016

(65) Prior Publication Data

US 2016/0253983 A1 Sep. 1, 2016

Related U.S. Application Data

(63) Continuation-in-part of application No. 14/988,329, filed on Jan. 5, 2016, which is a continuation of application No. 13/965,704, filed on Aug. 13, 2013, now Pat. No. 9,263,010.

(60) Provisional application No. 61/682,483, filed on Aug. 13, 2012.

(51) Int. Cl.

| | |
|---|---|
| ***G10D 13/08*** | (2006.01) |
| ***G10D 13/00*** | (2006.01) |
| ***G10D 13/02*** | (2006.01) |
| ***G10D 13/06*** | (2006.01) |

(52) U.S. Cl.

CPC ..... *G10D 13/006* (2013.01); *G10D 13/02* (2013.01); *G10D 13/025* (2013.01); *G10D 13/06* (2013.01)

(58) Field of Classification Search

CPC .... G10D 13/006; G10D 13/02; G10D 13/025; G10D 13/08

USPC ..... 84/422.1, 402

See application file for complete search history.

(56) References Cited

U.S. PATENT DOCUMENTS

| | | | | |
|---|---|---|---|---|
| 4,215,510 A * | 8/1980 | Worrell | A63B 19/00 446/28 |
| 7,534,948 B2 | 5/2009 | Rice | |
| 7,910,816 B2 * | 3/2011 | Glowacki | G10D 13/06 446/419 |
| 2006/0249004 A1 * | 11/2006 | Bunker | G10G 7/02 84/410 |

* cited by examiner

*Primary Examiner* — Jianchun Qin

(74) *Attorney, Agent, or Firm* — James M. Smedley LLC; James Michael Smedley, Esq.

(57) ABSTRACT

A percussion instrument configured as a shaker that is struck or shaken to produce a rattle or shaking sound. The shaker is a flexible, multi-chambered idiophone that can be struck or shaken at any angle or shaped into any number of configurations in order to generate a wide variety of sound characteristics. Furthermore, the flexibility of the shaker enables the instrument to be secured to a multi-purpose mounting bracket, which can then be attached to commonly available stands and arms that are used to support and arrange drums and cymbals.

7 Claims, 11 Drawing Sheets

FLEXIBLE SHAKER PERCUSSION INSTRUMENT

CROSS-REFERENCE TO RELATED APPLICATIONS

This application is continuation-in-part of U.S. Non-Provisional Utility patent application Ser. No. 14/988,329, filed on Jan. 5, 2016 and entitled "Multi-Tonal Box Drum Kit", which is a continuation of U.S. Non-Provisional Utility patent application Ser. No. 13/965,704, filed on Aug. 13, 2013 and entitled "Multi-Tonal Box Drum Kit", which claims the benefit of U.S. Provisional Patent Application No. 61/682,483, filed on Aug. 13, 2012 and entitled "Multi-Tonal Box Drum Kit", the entire disclosures of each and all of the above mentioned references are hereby incorporated herein by reference.

FIELD OF THE INVENTION

The present invention generally relates to a percussion instrument that produces a rattle or shaking sound when struck or shaken. Specifically, this invention relates to a flex shaker that can be shaped into any number of configurations and mounted in variety of orientations, all while allowing for the flex shaker to be struck or shaken at any angle to generate the rattle or shaking sound. Furthermore, the adaptable shape and mounting orientations of the flex shaker enable the flex shaker to have a varied sound characteristic depending at least in part on its shape or mounting orientation.

BACKGROUND

Musical instruments come in a variety of types and forms. In particular, percussion instruments are perhaps some of the most diverse with it comes to the various forms, shapes, and sizes that percussion instruments exist in. The variety of the percussion instruments, however, are important for the types of sound those instruments produce and this fact is especially evident with drums. The size and construction of a drum and other percussion instruments are the primary factors that determine what tones and sounds the drum or other percussion instrument will ultimately be capable of producing. As a result, a musician or group of musicians often has multiple types of drums and percussion instruments to adequately produce a variety of sounds and tones. This, however, can be very inconvenient as drums and percussion instruments tend to be bulky and more difficult to transport when compared to other types of instruments, therefore putting a musician in a less than ideal situation where the musician may not have the resources to efficiently transport all the drums and percussion instruments the musician needs.

Therefore, there is a need in the art for an apparatus that provides a compact and convenient multi-tonal drum box that is capable of producing the sounds of a variety of drums within the form factor of single drum body. Similarly, there is a need in the art for a percussion instrument that can flexibly configured into a variety of shapes and struck or shaken at any angle to generate a desired sound characteristic. These and other features and advantages of the present invention will be explained and will become obvious to one skilled in the art through the summary of the invention that follows.

SUMMARY OF THE INVENTION

Accordingly, it is an aspect of the present invention to provide a multi-tonal drum box that allows a musician to create the sounds of multiple types of drums from a single drum body. Furthermore, the multi-tonal drum box offers the musician a convenient and easy to transport drum that only requires the musician to transport one drum where many drums were previously required. Additionally, it is an aspect of the present invention to provide a shaker instrument or flex shaker that can be used independently of or together with the multi-tonal drum box. The shaker instrument is preferably configured as a multi-chambered, flexible tube that is capable of producing a variety of rattle sounds depending upon how the shaker is shaped and at which angle it is shaken or struck.

According to an embodiment of the present invention, a percussion instrument that produces a shaker effect when agitated, the percussion instrument comprising: a flex shaker that is a flexible tube internally divided into a plurality of shaker chambers each of which are defined by a first divider wall and a second divider wall and configured to retain an amount of rattle material, wherein the flex shaker is sufficiently flexible so as to be adaptably molded into a desired form.

According to an embodiment of the present invention, the percussion instrument further comprises a multi-purpose mounting bracket that comprises a bracket strip formed with one or more mounting points and one or more flex shaker connection points attached to the bracket strip.

According to an embodiment of the present invention, the mounting points include at least a center mounting point and an off-set mounting point.

According to an embodiment of the present invention, each of the flex shaker connection points are connector rings adapted to securely attach the flex shaker to the bracket strip.

According to an embodiment of the present invention, the connector rings are positioned on the top and bottom of each end of the bracket strip.

According to an embodiment of the present invention, the flex shaker is attached to the multi-purpose mounting bracket in a double-circle configuration.

According to an embodiment of the present invention, the multi-purpose mounting bracket is configured as a handle for shaking the flex shaker by hand.

According to an embodiment of the present invention, the multi-purpose mounting bracket is configured to attach to a drum accessory component.

According to an embodiment of the present invention, the rattle material is one or more materials comprising BBs, pellets, beads, sand, rocks, gravel, and rice.

According to an embodiment of the present invention, the desired form is one or more shapes selected from a group of shapes comprising helical shapes, arch shapes, wave shapes, figure-eight shapes, and angled shapes.

According to an embodiment of the present invention, a percussion instrument that produces a shaker effect when agitated, the percussion instrument comprising: a flex shaker that is a flexible tube internally divided into a plurality of shaker chambers each of which are defined by a first divider wall and a second divider wall and configured to retain an amount of rattle material, wherein the flex shaker is sufficiently flexible so as to be adaptably molded into a desired form, and a multi-purpose mounting bracket.

According to an embodiment of the present invention, the multi-purpose mounting bracket comprises a bracket strip formed with one or more mounting points and one or more flex shaker connection points attached to the bracket strip.

The foregoing summary of the present invention with the preferred embodiments should not be construed to limit the scope of the invention. It should be understood and obvious to one skilled in the art that the embodiments of the invention thus described may be further modified without departing from the spirit and scope of the invention.

DETAILED SPECIFICATION

Figure 1:
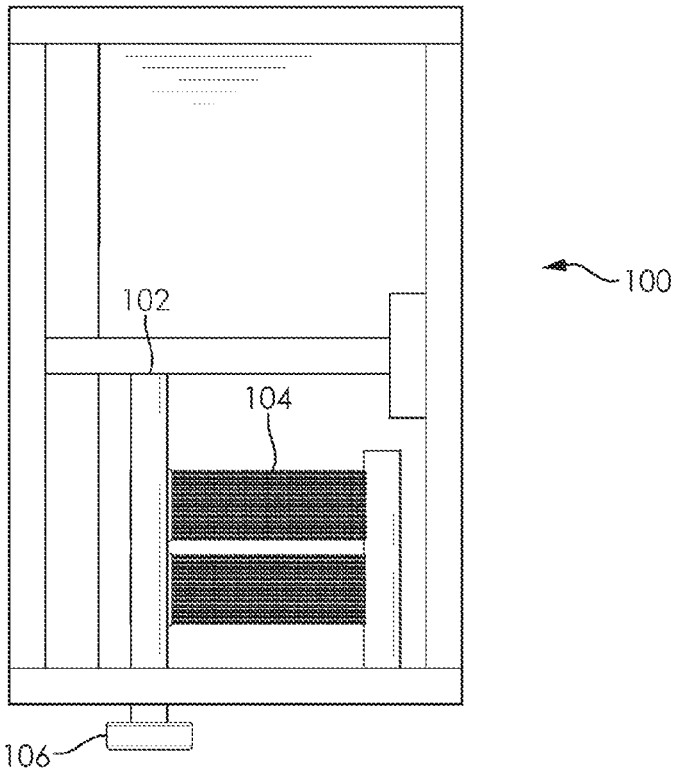
FIG. 1 shows a perspective view of a multi-tonal box drum kit, in accordance with an embodiment of the present invention.

The present invention generally relates to a percussion instrument configured as a shaker that is struck or shaken to produce a rattle or shaking sound. In a preferred embodiment, the shaker is a flexible, multi-chambered idiophone that can be struck or shaken at any angle or shaped into any number of configurations in order to generate a wide variety of sound characteristics. Furthermore, the flexibility of the shaker enables the instrument to be secured to a multi-purpose mounting bracket, which can then be attached to commonly available stands and arms that are used to support and arrange drums and cymbals.

According to an embodiment of the present invention, a multi-tonal box drum kit is comprised of a box shaped drum body portion. The drum body portion, in preferred embodiments, is comprised of a substantially rectangular shape that is solid on all six exterior walls except for one or more bass reflex ports. Alternative embodiments of the present invention may be comprised of a drum body portion of various shapes, including, but not limited to, squares, polygons and cylinders. One of ordinary skill in the art would appreciate that there are numerous shapes that could be used for the drum body portion of embodiments of the present invention, and embodiments of the present invention are contemplated for use with drum body portion of any shape. Further, in certain embodiments, the drum body portion may be devoid of bass reflex ports.

According to an embodiment of the present invention, the internal tonal structure is configured to provide shape and structure to the multi-tonal box drum kit such that the exterior walls of the drum body portion can attach to the internal tonal structure in a manner that allows for the generation of numerous drum sounds, percussion sounds or drum-like sounds. In a preferred embodiment of the present invention, the internal tonal structure is configured to provide seven unique tone zones. Each tone zone represents a zone whereby when that zone is played, a drum sound is generated. Drum sounds include, but are not limited to, bass drum sounds, snare drum sounds, tom-tom drum sounds, or any combination thereof. The tone of a tone zone may be directed by one or more of the size and shape of the tone zone, as directed by the internal tonal structure(s) and external surfaces of the multi-tonal box drum kit, the materials used for each tone zone, and the thickness of the materials used for the internal tonal structure(s) and external surfaces, or any combination thereof. For instance, the bass tone may be affected by the cubic inches of void space inside the multi-tonal box drum kit. In this manner, manipulation of the features of a tone zone may provide melodic capability to the instrument in such a way that the tones of the multi-tonal box drum kit may extend beyond drum tones and other percussion tones. One of ordinary skill in the art would appreciate that there are numerous drum sounds that could be produced by a tone zone, and embodiments of the present invention are contemplated for use with any drum sound.

According to an embodiment of the present invention, the multi-tonal box drum kit may be further comprised of one or more feet, configured to elevate the multi-tonal box drum kit off of the surface it rests upon. By elevating the multi-tonal drum kit, the one or more feet provide the ability for the multi-tonal drum kit to resonate as much as possible, creating deeper and richer tones and sounds. In a preferred embodiment, the multi-tonal box drum kit may utilize four large rubber feet. In alternate embodiments, any number of feet may be utilized.

According to an embodiment of the present invention, In usage, the multi-tonal box drum kit is played by a user sitting next to, behind, on or to a side of the multi-tonal box drum kit. This differs from other cajón drums, where the user sits on the drum while playing the instrument. Advantageously, by not sitting on the multi-tonal box drum kit, improved resonation and tones are achieved. Further, by not sitting on the multi-tonal box drum kit, the user is provided greater access to multiple exterior walls of the multi-tonal box drum kit, which are designed with a variety of unique tones and sounds much like that found in a full drum kit (i.e., the numerous tone zones). This allows the user to quickly switch from tone zone to tone zone, producing an entire array of drum sounds.

According to an embodiment of the present invention, the multi-tonal box drum kit may be further comprised of an adjustable snare component, which can produce everything from no snare to an extremely aggressive snare buzz, and everything in between. The adjustable snare component is attached to or integrally constructed with the internal tonal structure of the multi-tonal box drum kit. In certain embodiments, a snare adjustment component may extend through an exterior wall of the drum body portion and provide the user the ability to adjust the snare sound by adjusting the snare adjustment component. The snare sound may be adjusted from completely muted (i.e., off) to high rattle, or anywhere in between. In a preferred embodiment, the snare adjustment component is comprised of a knob that can be rotated to adjust the snare sound. In addition to adjusting the sound of the adjustable snare component, the adjustable snare component can also be adjusted to be used in various tone zones. For instance, the adjustable snare component can be adjusted to be used with the top tone zone on the top exterior wall of the multi-tonal box drum kit or adjusted to be used on one of the side tone zones on the side exterior walls of the multi-tonal box drum kit, allowing the player greater flexibility in the use of the drum.

According to an embodiment of the present invention, a bass tone zone and a snare tone zone of the multi-tonal box drum kit may be located on separate sides of the drum body portion of the multi-tonal box drum kit, allowing for superior definition between the bass and snare tones.

According to an embodiment of the present invention, the multi-tonal box drum kit can be played in multiple positions. In a preferred embodiment of the present invention, the multi-tonal box drum kit can be played on any one of the exterior walls of the multi-tonal box drum kit. Each exterior wall is configured to produce various drum sounds, depending on the arrangement of tone zones associated with the particular multi-tonal box drum kit.

According to an embodiment of the present invention, a shaker component is a percussion instrument that may be used as a component of the multi-tonal box drum kit or as a standalone instrument. In a preferred embodiment, the shaker component or flex shaker is a flexible, multi-chambered percussion instrument that is designed to be struck or shaken to achieve a percussive shaker sound. In the preferred embodiment, the flex shaker comprises a plurality of shaker chambers separately formed in a sealed tube or similar container. Each of the shaker chambers is configured to retain an amount of rattle material, including, but not limited to, BBs, pellets, beads, sand, rocks, gravel, and rice. In the preferred embodiment, the rattle material can be any variety or mix of appropriate materials based upon the desired sound characteristics for the flex shaker. Furthermore, the amount of rattle material that is loaded into each shaker chamber, and thereby the volume of each shaker chamber that is occupied by rattle material, can be varied according to the desired sound characteristics for the flex shaker.

According to an embodiment of the present invention, the flex shaker is a flexible tube or cylinder that is sealed at both ends. In a preferred embodiment, the flex shaker is made from a flexible plastic, such as cross-linked polyethylene ("PEX"), but other materials, such as carbon fiber or polyvinyl chloride ("PVC") would be obvious to one of skill in the art. Preferably, the tubing is malleable enough to be easily shaped or formed, yet rigid enough to hold the shape that is formed by a user. In the preferred embodiment, the tube forming the flex shaker is approximately 65 to 75 inches long end-to-end, but can be shortened or lengthened based on need for a particular application or design consideration for a desired sound characteristic. When configured in the preferred length, the flex shaker can be twisted into a double circle configuration where each of the circles is approximately 10 to 12 inches in diameter. In the preferred embodiment, the tube forming the flex shaker has a diameter of approximately 0.625 inches, but may be larger or smaller in diameter based on design considerations for a desired sound characteristic. One of ordinary skill in the art would appreciate that there are many suitable designs and materials that could be used to produce a flex shaker, and embodiments of the present invention are contemplated to take advantage of any such design or material.

According to an embodiment of the present invention, the flex shaker comprises a plurality of shaker chambers that are formed in the tube and configured to retain a rattle material. In a preferred embodiment, each shaker chamber is approximately 2 inches long when measured from center to center of the dividers that form each shaker chamber. In alternate embodiments, the shaker chambers could be configured to be longer or shorter depending upon the desired sound characteristics. Similarly, the length of each shaker chamber could be variable along the length of the tube to generate a variable rattle or shaking sound at different segments of the flex shaker. In the preferred embodiment, each of the sealed shaker chambers is configured in such a manner that a musician or other user of the flex shaker can tap, hit, shake or otherwise agitate the flex shaker from any angle or direction and have a rattle or similar sound produced.

According to an embodiment of the present invention, each shaker chamber of the flex shaker is defined by two divider walls, as well as the wall of the tube itself. In a preferred embodiment, the tube forming the flex shaker is sealed at one end, and amount of rattle material is poured into the tube. Next, a divider is inserted into or otherwise formed in the tube to create a sealed shaker chamber. Then, an amount of rattle material is again poured into the tube and another divider is inserted into or otherwise formed in the tube to create another sealed shaker chamber. This process is repeated until the entire tube of the flex shaker has been divided into multiple sealed shaker chambers, each of which contain an amount of rattle material. In particular, each consecutive shaker chamber shares a divider wall such that the second divider of a first shaker chamber forms that first divider of the immediately successive shaker chamber.

According to an embodiment of the present invention, the flex shaker may be mounted to a multi-purpose mounting bracket. In a preferred embodiment, the multi-purpose mounting bracket is configured with one or more flex shaker connection points at each end of a bracket strip that are adapted to secure the flex shaker to the bracket. In the preferred embodiment, the flex shaker connection points may be formed or fastened on either side of the multi-purpose mounting bracket. Additionally, each connection point may further include a cushioned or padded portion to prevent excessive strain and wear on the tube of the flex shaker. Preferably, the bracket strip forming the multi-purpose mounting bracket is sufficiently long so that it can hold the flex shaker in a double circle configuration. Furthermore, the multi-purpose mounting bracket is configured such that it can either serve as a handle or grip to shake the flex shaker by hand or be used to attach the flex shaker to various drum accessory components, such as stands and pedal apparatuses, which include, but are not limited to, fixed stands, hi-hat stands, and kick pedals. In the preferred embodiment, the multi-purpose mounting bracket is also configured with one or more mounting points that can be used to attach the multi-purpose mounting bracket to a drum component stand or mounting arm. Preferably, the multi-purpose mounting bracket is formed with at least two mounting points: one in the center of the bracket strip and another offset to one-side of the bracket strip. In particular, the center mounting point allows the multi-purpose mounting bracket to be squarely mounted or centered on a fixed stand or hi-hat stand, while the offset mounting point allow the multi-purpose mounting bracket to be mounted in an offset position above or below another drum component, such as a cymbal, so that both the flex shaker and cymbal are accessibly mounted on a single stand. One of ordinary skill in the art would appreciate there are many possible configurations and designs for a multi-purpose mounting racket, and embodiments of the present invention are contemplated for use with any such bracket.

According to an embodiment of the present invention, the flex shaker can be fashioned or manipulated into a variety of shapes to influence or enhance the rattle and shaking sounds generated by the flex shaker. In a preferred embodiment, the flex shaker may be mounted to a stand, bracket or similar support and struck with the hands or drum sticks or similar implements. Alternatively, the flex shaker may be held by hand and struck with a hand, drum stick, or similar implement. Importantly, the multi-chambered design of the flex shaker prevents the rattle material from pooling in one area, which enables a musician or other user of the flex shaker to tap, strike, shake or otherwise play the flex shaker from any angle or direction and have a rattle or similar sound produced. Furthermore, because the flex shaker can be played from a variety of angles and shaped configurations, a user of the flex shaker can manipulate the sound characteristics of the flex shaker by taking advantage of the various shaped configurations, mounting options, and strike angles. The flexible tubing that forms the flex shaker allows for the formation of a wide variety of deflection arcs, including, but not limited to, circles, figure-eights, horseshoes, angular shapes, and helical shapes each of which contribute to the sound characteristics generated by the flex shaker.

Figure 2:
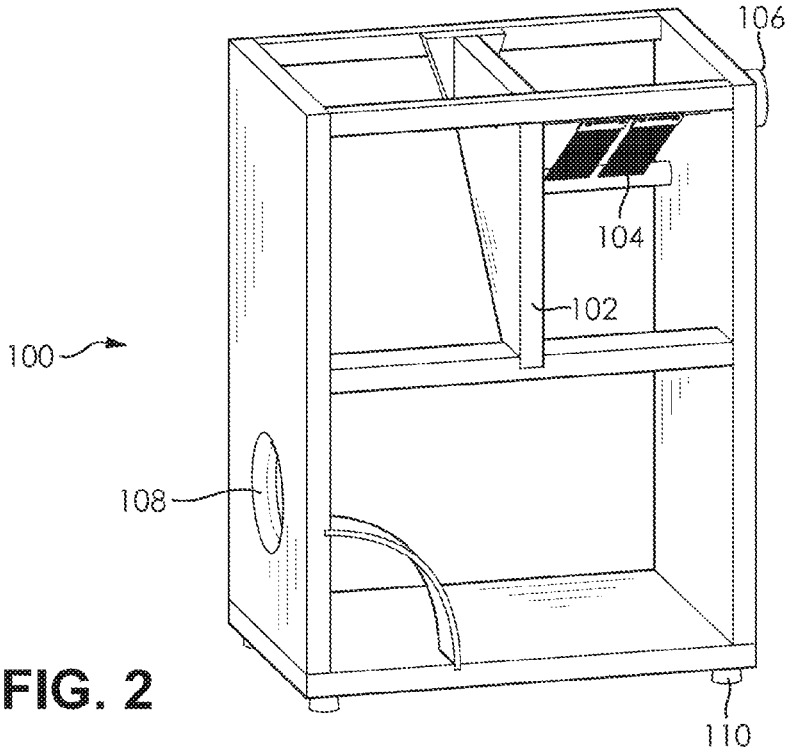
FIG. 2 shows a side view of a multi-tonal box drum kit, in accordance with an embodiment of the present invention.

Turning now to FIGS. 1-2, views of an exemplary embodiment of the multi-tonal box drum kit 100 is shown. In these views, the internal tonal structure 102 of the multi-tonal box drum kit 100 is shown. Various support arms are shown as well as tone generating arms. Support arms provide the dual purpose of shaping the tone zones of the multi-tonal box drum kit as well as providing support for the overall structure. Tone generating arms are configured to shape tone zones for the multi-tonal box drum kit without providing significant structural support. Also shown in these views are the adjustable snare component 104 and the snare adjustment component 106. The snare adjustment component 106 regulates the adjustable snare component 104 to product varying snare drum sounds. Finally, FIG. 2 shows a bass reflex port 108 and feet 110.

Figure 3A:
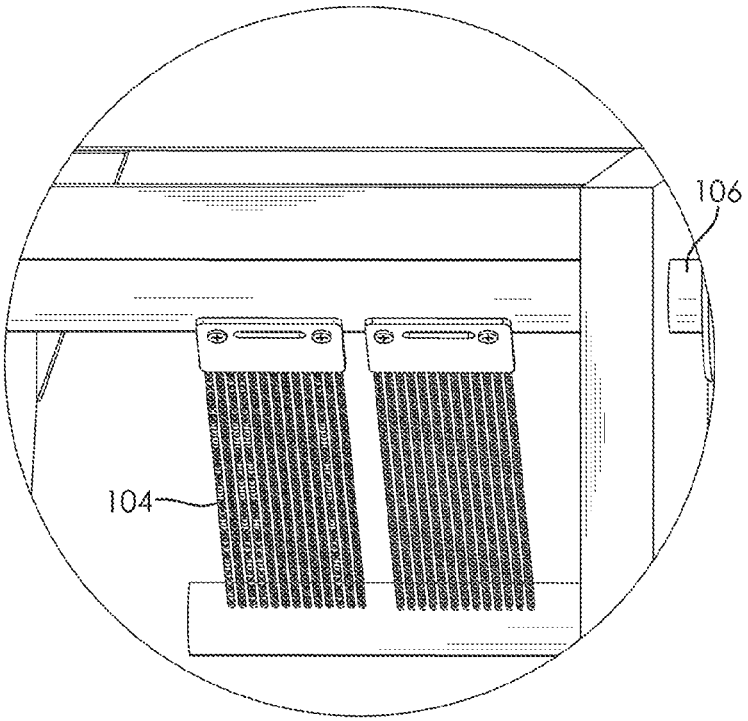
FIGS. 3A-C show a detailed view of a snare drum component of a multi-tonal box drum kit, in accordance with an embodiment of the present invention.
Figure 3B:
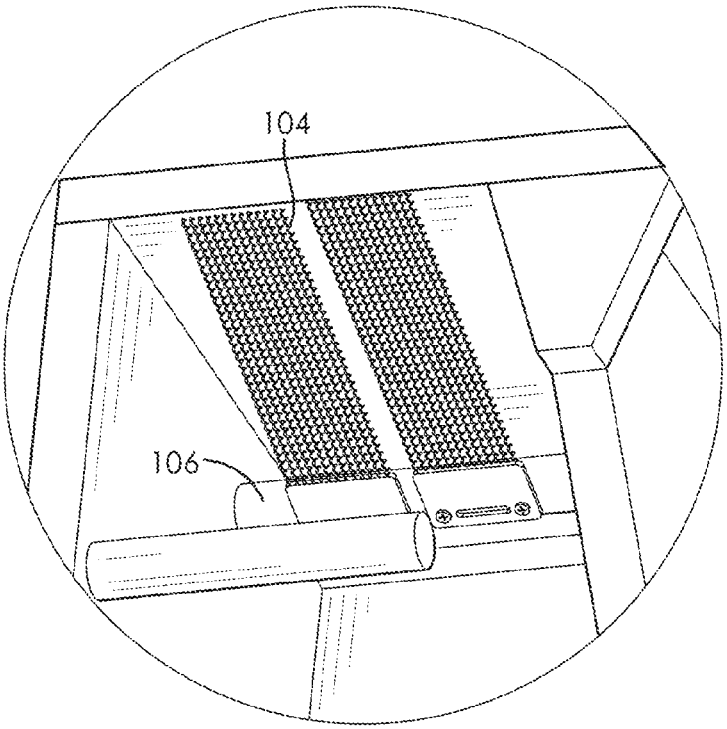
Figure 3C:
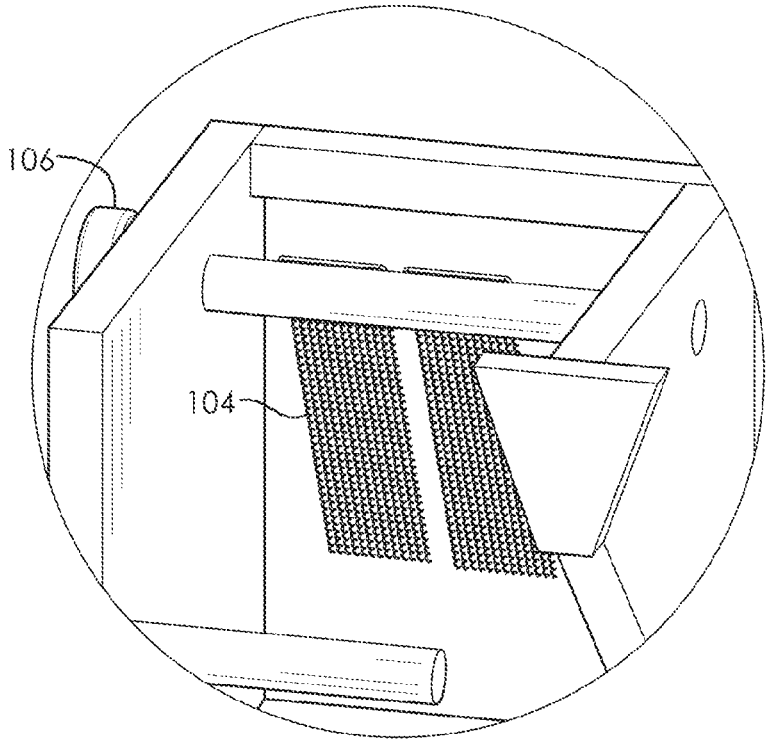
Figure 4:
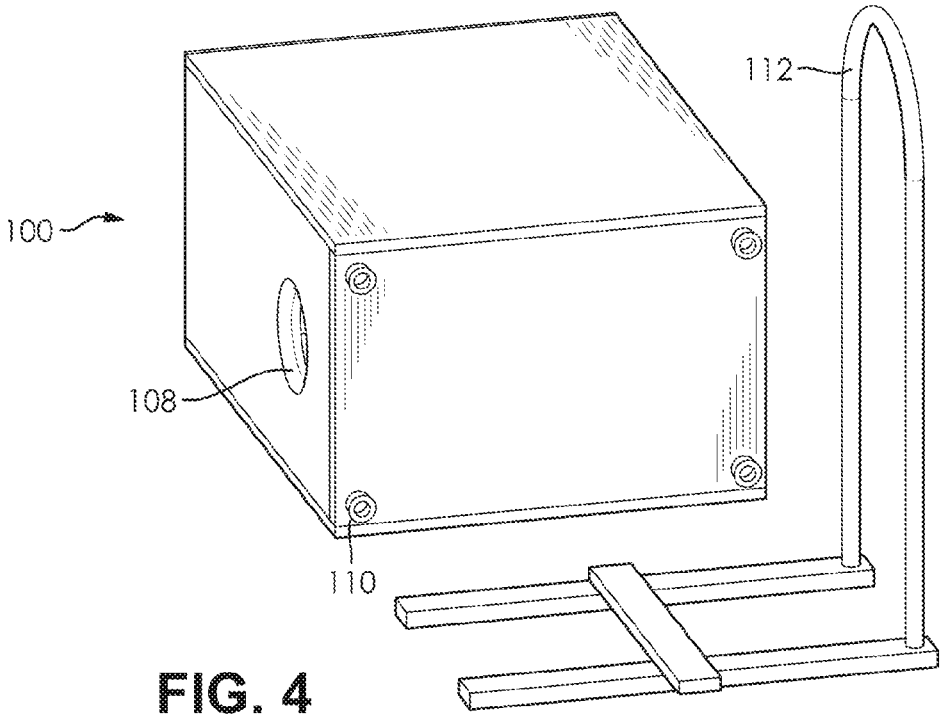
FIG. 4 shows a bottom view of a multi-tonal box drum kit, in accordance with an embodiment of the present invention.
Figure 5:
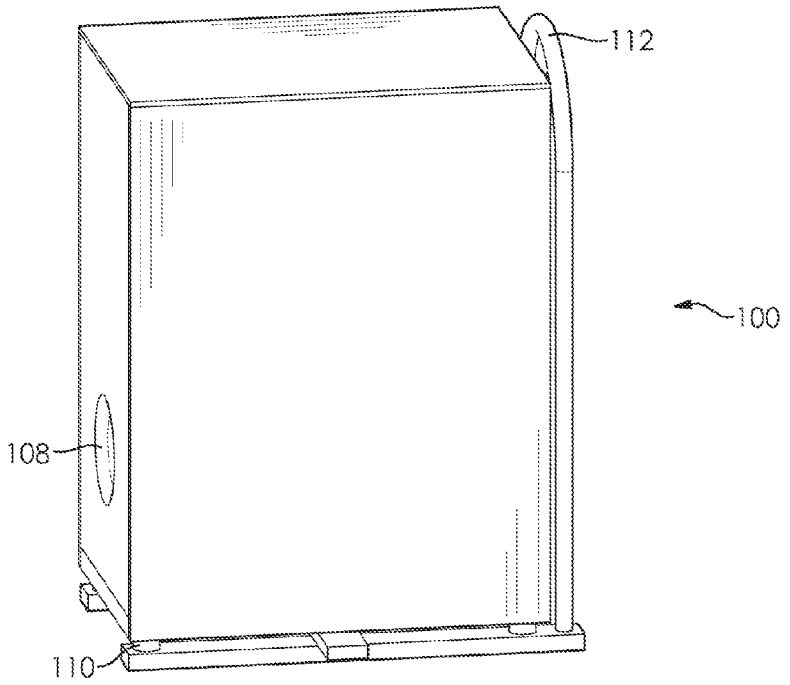
FIG. 5 shows a side view of a multi-tonal box drum kit, in accordance with an embodiment of the present invention.
Figure 6:
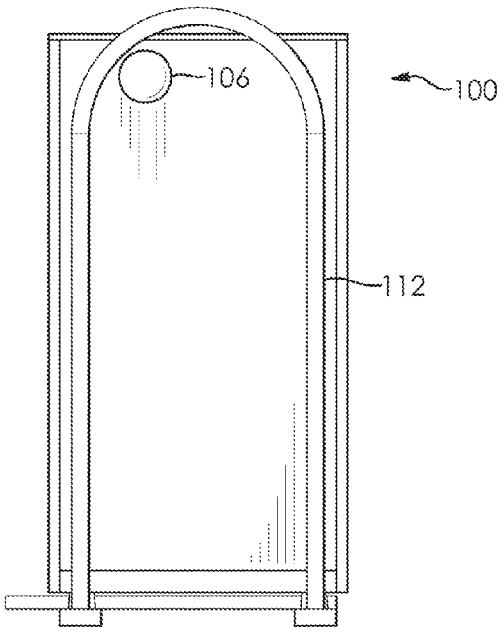
FIG. 6 shows a rear view of a multi-tonal box drum kit, in accordance with an embodiment of the present invention.
Figure 7:
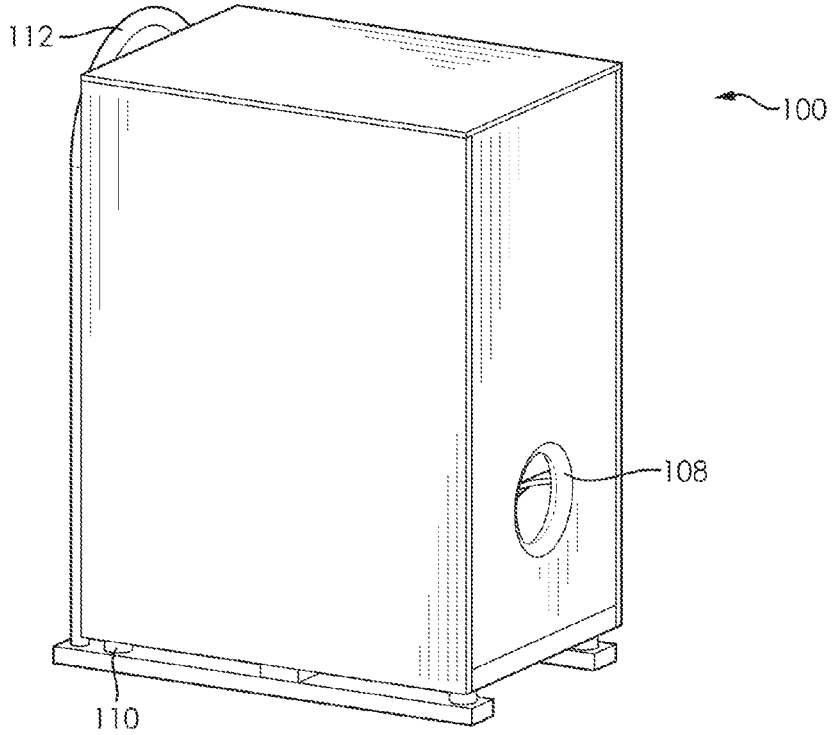
FIG. 7 shows a perspective view of a multi-tonal box drum kit, in accordance with an embodiment of the present invention.
Figure 8:
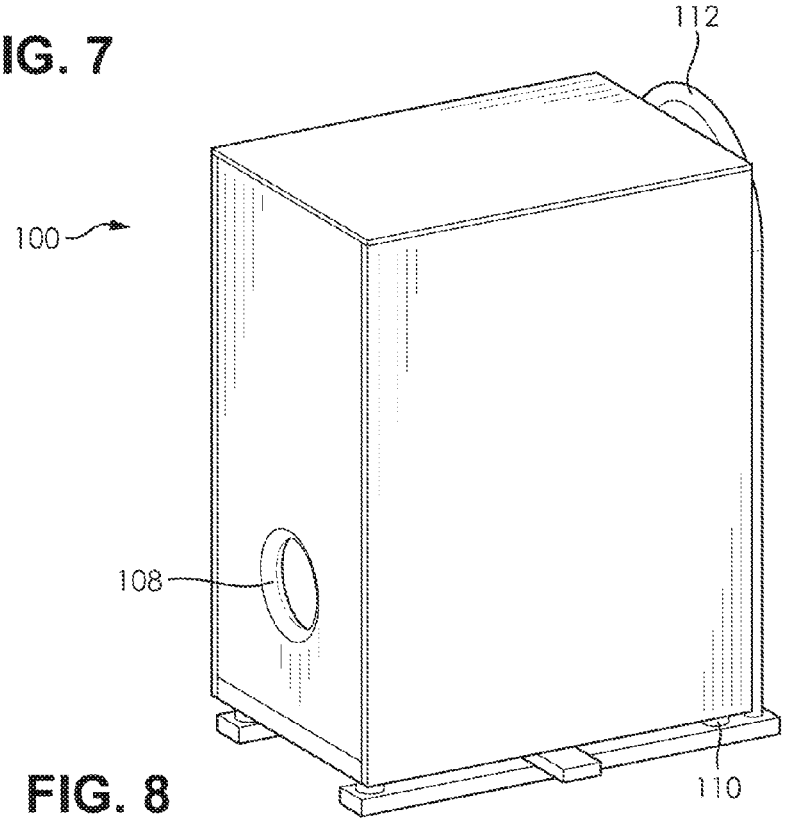
FIG. 8 shows a perspective view of a multi-tonal box drum kit, in accordance with an embodiment of the present invention.

Turning now to FIGS. 3A-C, a zoomed-in view of an adjustable snare component 104 is shown. In this exemplary embodiment, the adjustable snare component 104 is comprised of an adjustable rotating arm attached to a snare component and a second stationary arm. The adjustable rotating arm extends through the exterior wall of the box shaped drum body portion (generally on the rear exterior wall of the multi-tonal box drum kit) and attaches to a snare adjustment component 106, such as a knob, that allows the user to adjust the adjustable snare component conveniently from a playable position.

Turning now to FIGS. 4-9, views of an embodiment of a multi-tonal box drum kit 100 are shown. In these views, various angles are shown of a multi-tonal box drum kit 100, including an optional shaker component (or flex shaker) 112 and a kick pedal apparatus 114, which includes a kick pedal 116 and a beater component 118. These views also include other components of the multi-tonal drum box kit 100, including a snare adjustment component 106, a bass reflex port 108, and feet 110.

Figure 9:
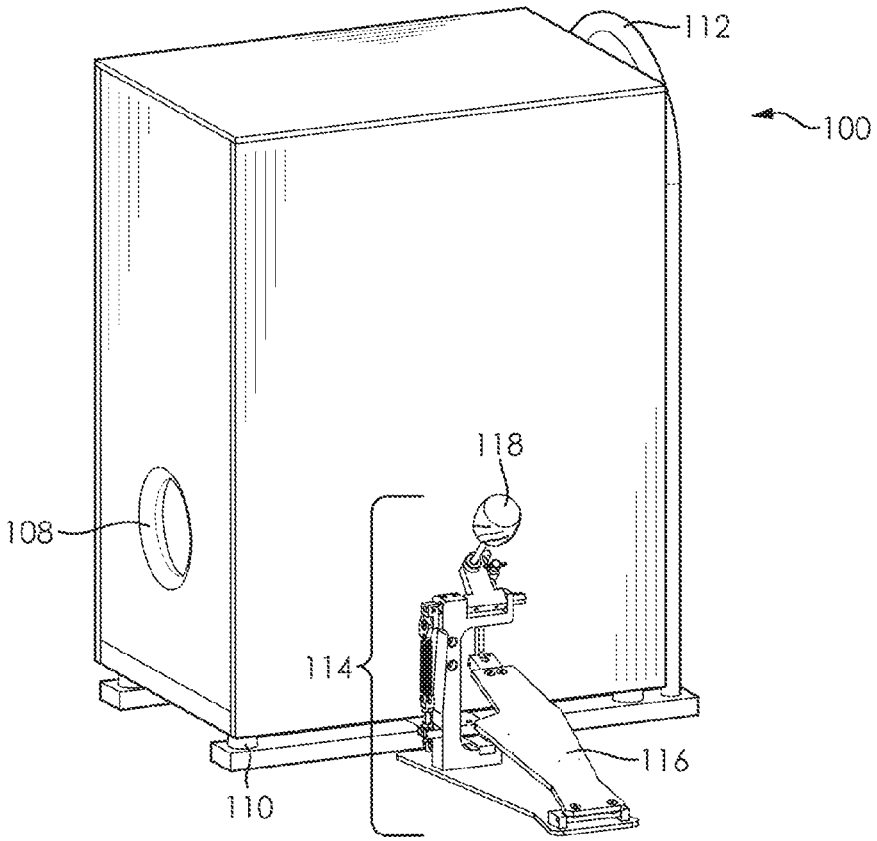
FIG. 9 shows a perspective view of a multi-tonal box drum kit, in accordance with an embodiment of the present invention.
Figure 10:
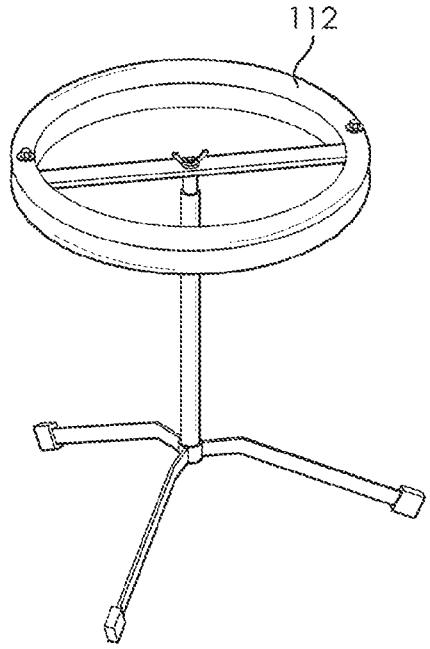
FIG. 10 shows a view of a component of a multi-tonal box drum kit, in accordance with an embodiment of the present invention.

According to an embodiment of the present invention, the flex shaker 112 may be its own instrument (as shown in FIG. 10), or a component of the multi-tonal box drum kit 100 (as shown in FIGS. 4-9). In certain embodiments, the flex shaker 112 is comprised of a plurality of sealed chambers containing a rattle component or rattle material (e.g., BBs, pellets, beads). The sealed chambers are configured in such a manner that a musician or other user of the flex shaker can tap, hit, shake or otherwise manipulate the flex shaker from any angle or direction and have a rattle or similar sound produced. As shown in FIGS. 4-10, the flex shaker is configured in a horseshoe shape or otherwise rounded shape and comprised of a plurality of individual sealed chambers containing BBs. One of ordinary skill in the art would appreciate that the flex shaker may be shaped in any number of shapes and may be comprised of any number of sealed chambers, and embodiments of the present invention are contemplated for use with any shape and number of sealed chambers for its flex shaker.

According to an exemplary embodiment of the present invention, a kick pedal apparatus 114 (as shown in FIG. 9) may be configured to allow for a musician or other user to create a kick drum tone from the multi-tonal box drum kit 100 without using his/her hands. In this manner, the user's foot or other limb may be utilized to generate the desired tones. In certain embodiments, the kick pedal apparatus may be comprised of a kick drum pedal 116 and a beater component 118. One of ordinary skill in the art would appreciate that there are many suitable configurations for a kick pedal apparatus, and embodiments of the present invention are contemplated for use with any such configuration of kick pedal apparatus.

Turning now to FIGS. 11 *a-c*, according to an exemplary embodiment of the present invention, a beater component 118 may be comprised of an attachment rod 120, an interior dowel rod 122, a middle cushion component 124, and an exterior tapping component 126. The attachment rod 120 is configured to secure the components of the beater component 118 to a kick drum pedal. The other components of the beater component (i.e., the interior dowel rod 122, the middle cushion component 124, and exterior tapping component 126) are configured to be used be used in conjunction with one another to hit an exterior wall of the drum body portion multi-tonal drum kit to generate a drum tone. Further, the combination of the interior dowel rod 122, middle cushion component 124, and exterior tapping component 126 are configured to provide tones that mimic those generated by a hand tapping on the multi-tonal drum kit. This occurs through the selection of materials for the interior dowel rod 122, the middle cushion component 124, and exterior tapping component 126 that approximate the characteristics of a human hand. The interior dowel rod 122 is designed to mimic bones in the human hand; the middle cushion component 124 designed to mimic the muscle and tissue of the human hand; and the exterior tapping component 124 designed to mimic the skin of the human hand. In combination, the tone produced when the beater component 118 strikes the multi-tonal drum kit is a close approximation of the sounds generated when a human hand hits the multi-tonal drum kit.

Figure 11C:
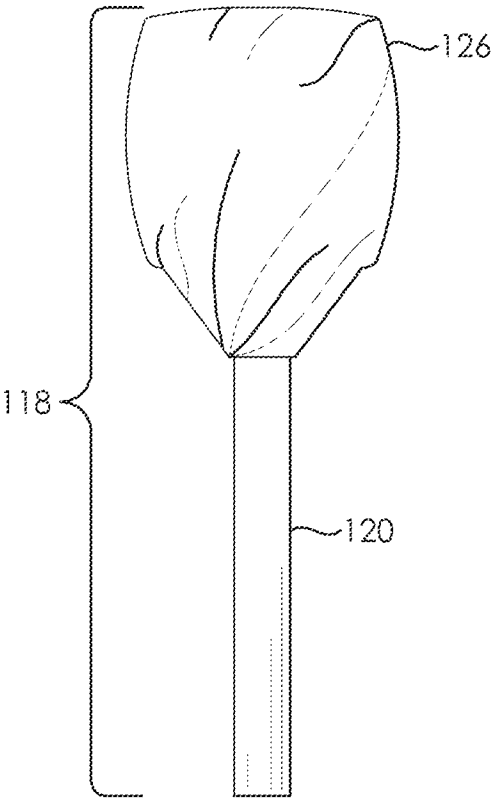
FIGS. 11*a*-11*c* shows a perspective view of a component of a box drum kit, in accordance with an embodiment of the present invention.
Figure 11B:
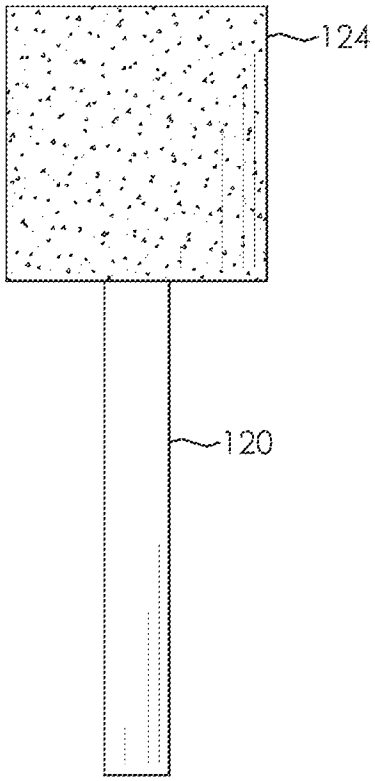
Figure 11A:
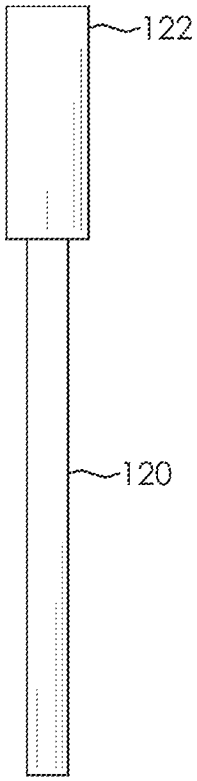
Figure 12:
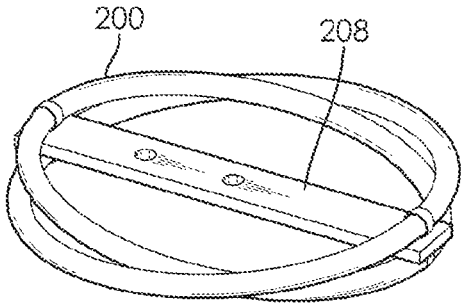
FIG. 12 shows a perspective view of a flex shaker on a multi-purpose mounting bracket, in accordance with an embodiment of the present invention.
Figure 13:
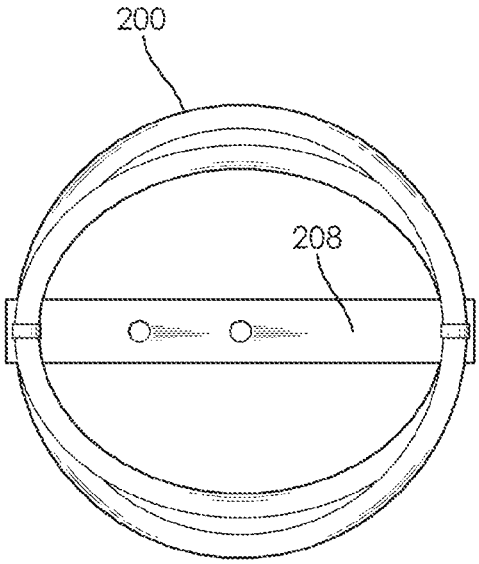
FIG. 13 shows a top view of a flex shaker on a multi-purpose mounting bracket, in accordance with an embodiment of the present invention.
Figure 14:
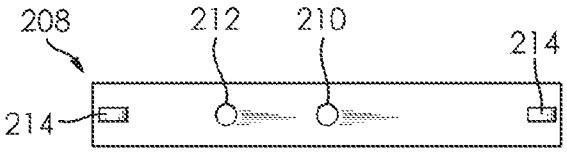
FIG. 14 shows a top view of a multi-purpose mounting bracket for a flex shaker, in accordance with an embodiment of the present invention.
Figure 15:
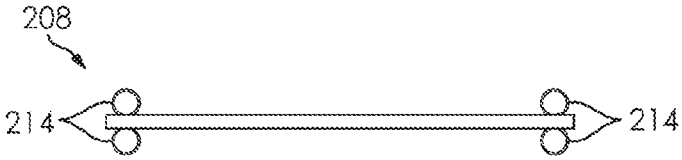
FIG. 15 shows a front view of a multi-purpose mounting bracket for a flex shaker, in accordance with an embodiment of the present invention.
Figure 16:
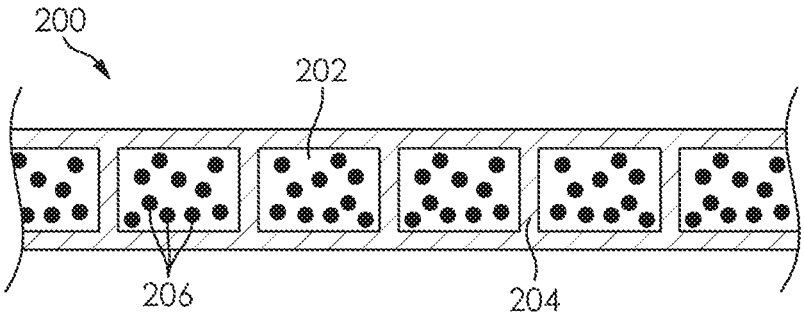
FIG. 16 shows a cross-section view of the shaker chambers of a flex shaker, in accordance with an embodiment of the present invention.

Turning now to FIG. 11*a*, according to an exemplary embodiment of the present invention, an interior dowel rod 122 may be comprised of, for instance, wooden materials or other materials approximating the density and/or other characteristics of bone, including animal bone. One of ordinary skill in the art would appreciate that there are numerous materials that could be utilized for the interior dowel rod, and embodiments of the present invention are contemplated for use with any material.

Turning now to FIG. 11*b*, according to an exemplary embodiment of the present invention, a middle cushion component 124 may be comprised of, for instance, Styrofoam or other materials approximating the density and/or other characteristics of human tissue. One of ordinary skill in the art would appreciate that there are numerous materials that could be utilized for the middle cushion component, and embodiments of the present invention are contemplated for use with any material.

Turning now to FIG. 11*c*, according to an exemplary embodiment of the present invention, an exterior tapping component 126 may be comprised of, for instance, animal skin, leather or other materials approximating the density and/or other characteristics of human skin. One of ordinary skill in the art would appreciate that there are numerous materials that could be utilized for the exterior tapping component, and embodiments of the present invention are contemplated for use with any material.

Turning now to FIGS. 12-16, various views of a flex shaker and a multi-purpose mounting bracket, in accordance with an embodiment of the present invention. In a preferred, the flex shaker 200 is coiled into a double circle configuration on the multi-purpose mounting bracket 208 using connection points 214 on each end of the multi-purpose mounting bracket 208. In a preferred embodiment, the mounting bracket has connection points 214 on the top and bottom of each end of the bracket strip. The multi-purpose mounting bracket also has two mounting points: a center mounting point 210 and an offset mounting point 212. The multi-purpose mounting bracket 208 can be used to attached the flex shaker 200 to various drum stands and pedals or alternatively be used as a handle with which a user can shake the flex shaker 200. As show in FIG. 16, the flex shaker 200 is a multi-chambered percussion instrument. Each shaker chamber 202 of the flex shaker 200 is defined by divider 204 at each side of the flex chamber 202. Furthermore, each flex chamber 202 is filled with a rattle material 206 that produces a shaking or rattle sound when the flex shaker 200 is shaken or struck.

Figure 17:
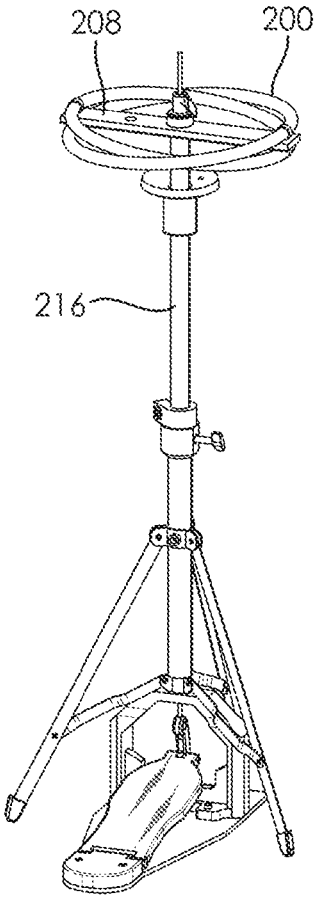
FIG. 17 shows a flex shaker attached to a hi-hat stand using the center mounting point of the multi-purpose mounting bracket, in accordance with an embodiment of the present invention.
Figure 18:
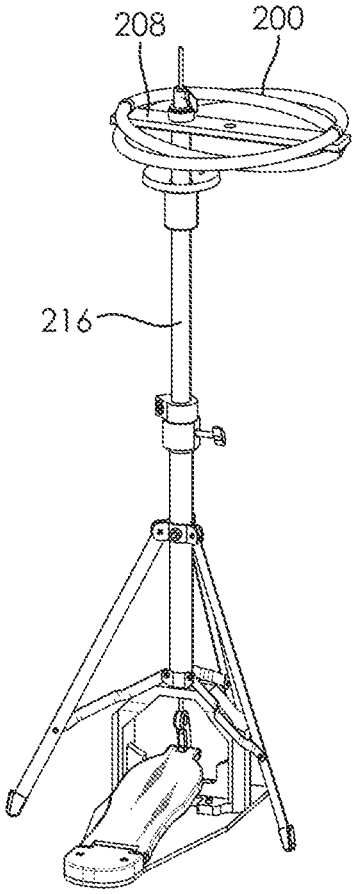
FIG. 18 shows a flex shaker attached to a hi-hat stand using the off-set mounting point of the multi-purpose mounting bracket, in accordance with an embodiment of the present invention.
Figure 19:
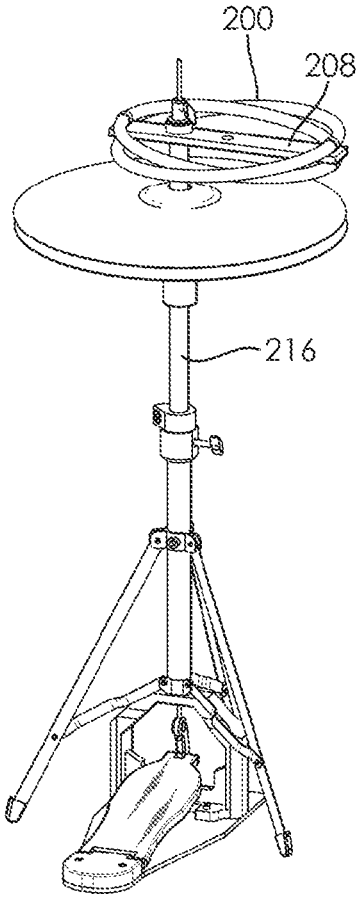
FIG. 19 shows a flex shaker attached above a hi-hat cymbal using the off-set mounting point of the multi-purpose mounting bracket, in accordance with an embodiment of the present invention.
Figure 20:
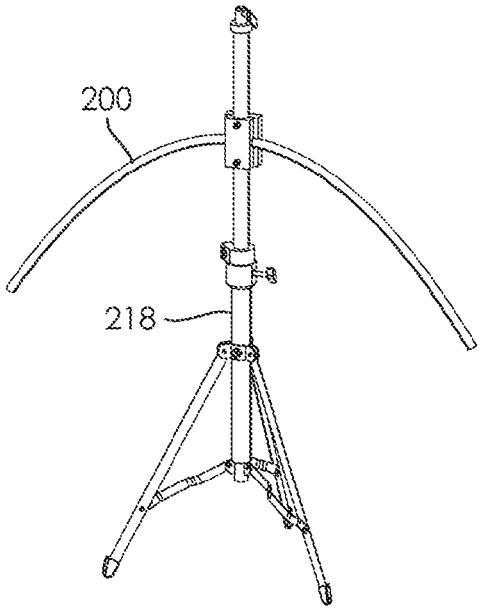
FIG. 20 shows a flex shaker shaped in an arched configuration and attached to a stand, in accordance with an embodiment of the present invention.
Figure 21:
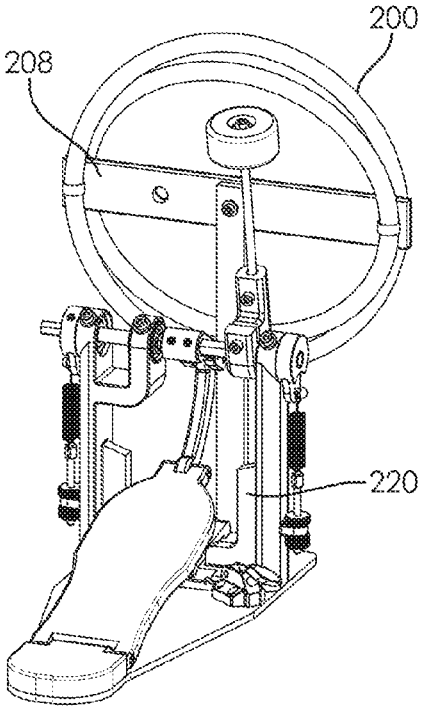
FIG. 21 shows a flex shaker attached to a kick pedal apparatus using the center mounting point of the multi-purpose mounting bracket, in accordance with an embodiment of the present invention.

Turning now to FIGS. 17-21, the shaker component attached to various drum equipment stands and pedals, including through the use of the multi-purpose mounting bracket. As shown by FIGS. 17 and 18, the flex shaker 200 can be mounted by itself to a hi-hat stand 216 using the multi-purpose mounting bracket 208. FIG. 17 shows the flex shaker 200 mounted to the hi-hat stand using the center mounting point of the multi-purpose mounting bracket 208, while FIG. 18 shows the flex shaker 200 mounted to the hi-hat stand using the offset mounting point of the multi-purpose mounting bracket 208. As shown by FIG. 19, the flex shaker 200 can be mounted to a hi-hat stand 216 above a hi-hat cymbal. The use of the offset mounting point of the multi-purpose mounting bracket 208 allows the flex shaker 200 to be offset from the cymbal so that both instruments are accessible. As shown by FIG. 20, the flex shaker 200 can be attached to a standard drum component stand 218 without the using the multi-purpose mounting bracket. As shown in FIG. 21, the flex shaker 200 can be mounted to a kick pedal apparatus using the multi-purpose mounting bracket 208.

Figure 22A:
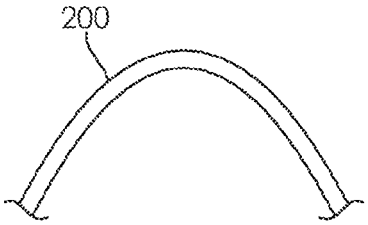
FIGS. 22A-C shows a flex shaker shaped into various configurations, in accordance with embodiments of the present invention.
Figure 22B:
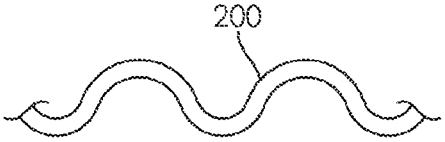
Figure 22C:
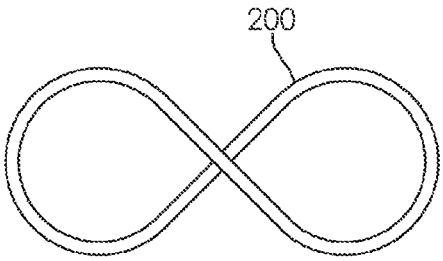

Turning now to FIGS. 22A-C, a flex shaker shaped into various configurations, in accordance with embodiments of the present invention. The flex shaker 200 can be shaped into a variety of configurations including, but not limited to arched shapes (as shown in FIG. 22A), wave shapes (as shown in FIG. 22B), and figure-eight shapes (as shown in FIG. 22C).

According to an embodiment of the present invention, the multi-tonal box drum kit may be constructed from various materials. The choice of materials assists in the generation of specific tones and sounds. In certain embodiments, various materials may be utilized in the construction of the various components of the multi-tonal box drum kit, including spruce, maple, redwood, African hardwoods, cherry, carbon fiber, fiberglass, Plexiglas, and oak. One of ordinary skill in the art would appreciate that there are numerous types of construction materials that could be utilized with embodiments of the present invention, and embodiments of the present invention are contemplated for use with any construction materials.

According to an embodiment of the present invention, the various exterior walls of the generally box-shaped drum body portion of the multi-tonal box drum kit may be connected via one or more attachment means. In preferred embodiments, the various exterior walls are connected via attachment means that create substantially air-tight seals allowing for greater resonance and tone. Exemplary attachment means include dove-tailed connections. One of ordinary skill in the art would appreciate that there are numerous types of attachment means that could be utilized with embodiments of the present invention, and embodiments of the present invention are contemplated for use with any type of attachment means.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

The invention claimed is:

1. A percussion instrument that produces a shaker effect when agitated, said percussion instrument comprising:

a flex shaker that is a flexible tube internally divided into a plurality of shaker chambers each of which are defined by a first divider wall and a second divider wall and configured to retain an amount of rattle material, wherein said flex shaker is sufficiently flexible so as to be adaptably molded into a desired form; and a multi-purpose mounting bracket that comprises a bracket strip formed with one or more mounting points and one or more flex shaker connection points attached to said bracket strip, wherein each of said flex shaker connection points are connector rings adapted to securely attach said flex shaker to said bracket strip, and wherein said connector rings are positioned on the top and bottom of each of said bracket strip.

2. The percussion instrument of claim 1, wherein said mounting points include at least a center mounting point and an off-set mounting point.

3. The percussion instrument of claim 1, wherein said flex shaker is attached to said multi-purpose mounting bracket in a double-circle configuration.

4. The percussion instrument of claim 1, wherein said multi-purpose mounting bracket is configured as a handle for shaking said flex shaker by hand.

5. The percussion instrument of claim 1, wherein said multi-purpose mounting bracket is configured to attach to a drum accessory component.

6. The percussion instrument of claim 1, wherein said rattle material is one or more materials comprising BBs, pellets, beads, sand, rocks, gravel, and rice.

7. The percussion instrument of claim 1, wherein said desired form is one or more shapes selected from a group of shapes comprising helical shapes, arch shapes, wave shapes, figure-eight shapes, and angled shapes.

* * * * *